US012291833B1

(12) United States Patent
Yeom et al.

(10) Patent No.: US 12,291,833 B1
(45) Date of Patent: May 6, 2025

(54) SAFETY RECOVERY SUPPORT FIXTURE

(71) Applicants: AORES CO., LTD, Gyeongsangbuk-do (KR); Jin Se Yeom, Daegu (KR); Soon Hi Jo, Daegu (KR)

(72) Inventors: Jin Se Yeom, Daegu (KR); Soon Hi Jo, Daegu (KR)

(73) Assignees: AORES CO., LTD, Chilgok-Gun (KR); Jin Se Yeom, Daegu (KR); Soon Hi Jo, Daegu (KR)

( * ) Notice: Subject to any disclaimer, the term of this patent is extended or adjusted under 35 U.S.C. 154(b) by 0 days.

(21) Appl. No.: 18/983,887

(22) Filed: Dec. 17, 2024

(30) Foreign Application Priority Data

Dec. 27, 2023 (KR) ..... 10-2023-0192681

(51) Int. Cl.
*E02D 5/80* (2006.01)

(52) U.S. Cl.
CPC ..... *E02D 5/803* (2013.01); *E02D 2600/10* (2013.01); *E02D 2600/30* (2013.01)

(58) Field of Classification Search
CPC . E02D 5/803; E02D 2600/10; E02D 2600/30; E02D 5/24; E02D 27/12; E02D 5/28; E02D 5/285; E02D 5/56
USPC ..... 52/155, 156, 160, 161, 162, 164; 405/252.1, 252.3
See application file for complete search history.

(56) References Cited

U.S. PATENT DOCUMENTS 314,303 A * 3/1885 Adams ..... E02D 5/803 52/160
362,183 A * 5/1887 Runyon ..... E02D 5/803 24/711.1
761,277 A * 5/1904 Wilbur ..... E02D 5/803 411/340
798,654 A * 9/1905 Bliler ..... E02D 5/803 43/6
912,018 A * 2/1909 McNutt ..... E02D 5/803 52/164

(Continued)

FOREIGN PATENT DOCUMENTS

JP 2010-025240 A 2/2010
KR 10-2013-0040075 A 4/2013

OTHER PUBLICATIONS

Korea Office Action Request for Submission of an opinion dated Apr. 24, 2024 for Korean Patent Application No. 10-2023-0192681.

(Continued)

*Primary Examiner* — Brian E Glessner
*Assistant Examiner* — Adam G Barlow
(74) *Attorney, Agent, or Firm* — Sughrue Mion, PLLC

(57) ABSTRACT

The present invention relates to a safety recovery support fixture with a new structure that can easily be fixed to be buried in the ground, tidal flats, the ocean, or the like and can easily be recovered as necessary. The safety recovery support fixture according to the present invention can be fixed to a ground surface (1) by spreading anchor blades (22) in a state in which a fixer (20) is inserted into the ground surface (1) and can be removed by being pulled upward in the state in which the anchor blades (22) are narrowed. Accordingly, the safety recovery support fixture can be firmly fixed to the ground surface (1) to support a structure and can be easily recovered after the structure is demolished, and there is an advantage that environmental destruction can be prevented.

2 Claims, 11 Drawing Sheets

(56) References Cited

U.S. PATENT DOCUMENTS 945,269 A * 1/1910 Fuchs ..... E02D 5/803 114/305
954,510 A * 4/1910 Fuchs ..... E02D 5/803 52/164
1,695,523 A * 12/1928 Bilhorn ..... E02D 5/803 405/244
1,807,488 A * 5/1931 Michalicek ..... E02D 5/803 52/159
1,907,811 A * 5/1933 Hollos ..... E02D 5/801 52/156
2,025,853 A * 12/1935 Emry ..... E02D 5/803 52/164
2,141,034 A * 12/1938 Cummins ..... E02D 5/803 52/164
2,250,780 A * 7/1941 Stroup ..... E02D 5/803 312/405
2,315,339 A * 3/1943 Klein ..... E02D 5/803 52/160
2,343,350 A * 3/1944 Warren ..... B64F 1/12 52/156
2,403,150 A * 7/1946 Pieper ..... E02D 5/803 52/160
2,404,151 A * 7/1946 Washam ..... E02D 5/803 52/164
2,490,465 A * 12/1949 Ogburn ..... E02D 5/803 52/164
2,705,548 A * 4/1955 Lionberger ..... E04H 12/223 52/153
2,779,240 A * 1/1957 Gaydos ..... E01F 9/608 359/542
2,873,829 A * 2/1959 Wiegmann ..... E02D 5/803 52/164
2,910,149 A * 10/1959 Lionberger ..... E04H 12/223 126/30
2,955,430 A * 10/1960 Alston ..... E02D 5/803 52/156
3,017,000 A * 1/1962 Hynds ..... B63B 21/26 52/164
3,056,477 A * 10/1962 Wooley ..... E02D 5/805 29/239
3,279,136 A * 10/1966 Smith ..... E02D 5/54 405/244
3,397,750 A * 8/1968 Wicklund ..... A01K 97/01 175/18
3,512,319 A * 5/1970 Piacentino ..... E02D 5/803 52/162
3,785,100 A * 1/1974 Watanabe ..... E02D 5/805 52/162
4,023,314 A * 5/1977 Tanner ..... E04B 1/34347 52/162
4,285,993 A 8/1981 Green, Sr.
6,764,251 B1 * 7/2004 Schnur ..... E02D 27/50 52/162
9,890,511 B1 * 2/2018 Adams ..... E02D 5/808
11,293,157 B2 * 4/2022 Kelleher ..... E02D 27/525
2016/0010304 A1 * 1/2016 Barrett ..... E02D 5/56 405/259.1
2024/0084539 A1 * 3/2024 Wang ..... E02D 5/56

OTHER PUBLICATIONS

Korea Office Action Written decision on Registration dated Oct. 6, 2024 for Korean Patent Application No. 10-2023-0192681.

* cited by examiner

[FIG. 1]
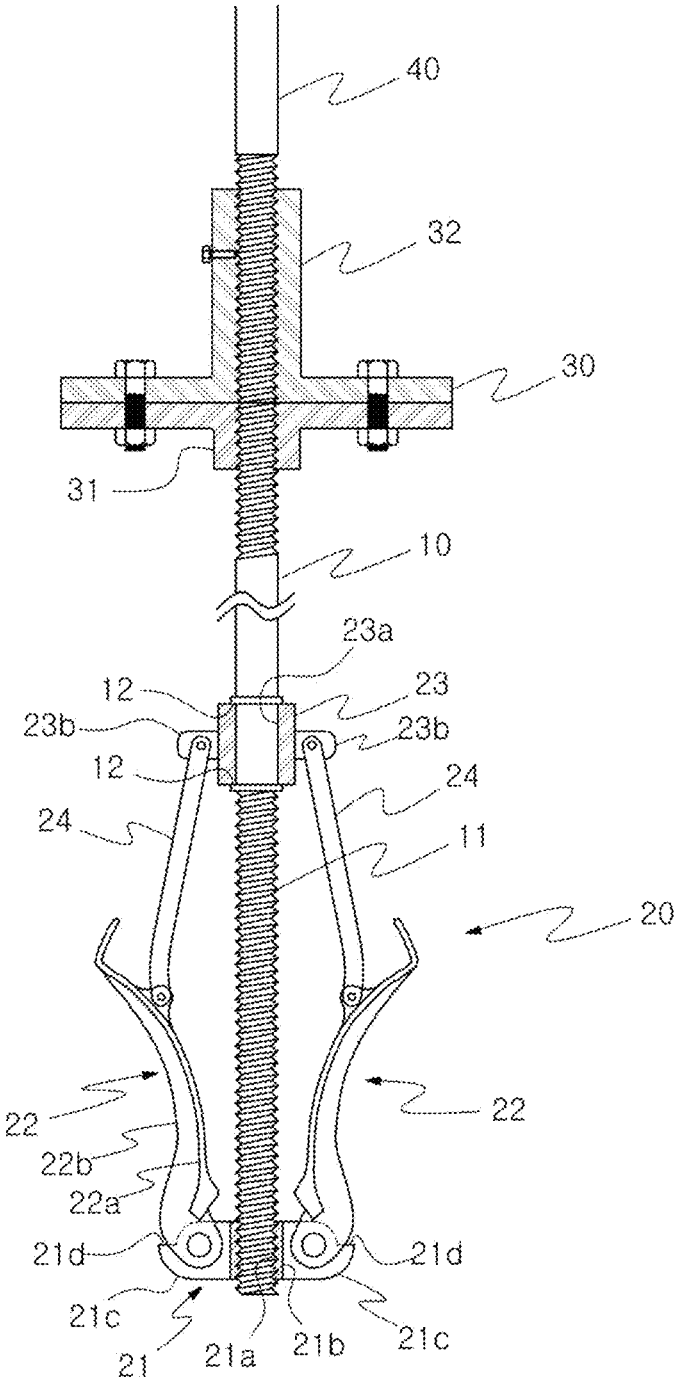

[FIG. 2]
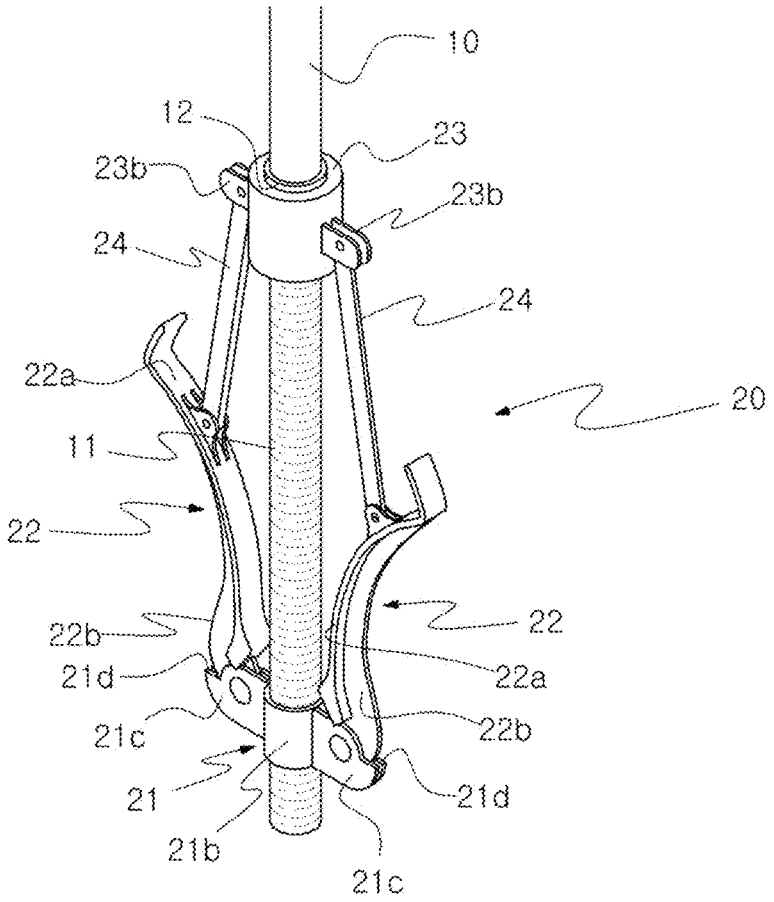

[FIG. 3]
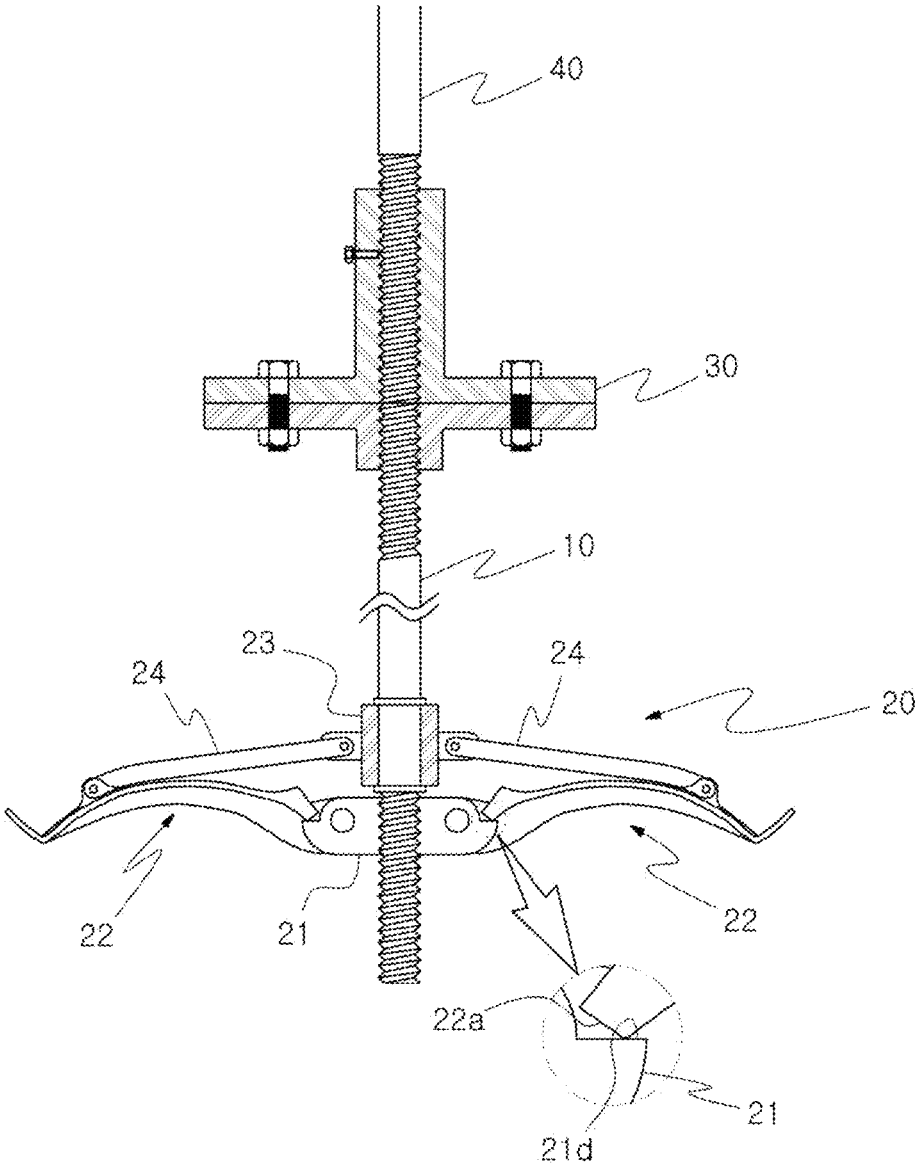

[FIG. 4]
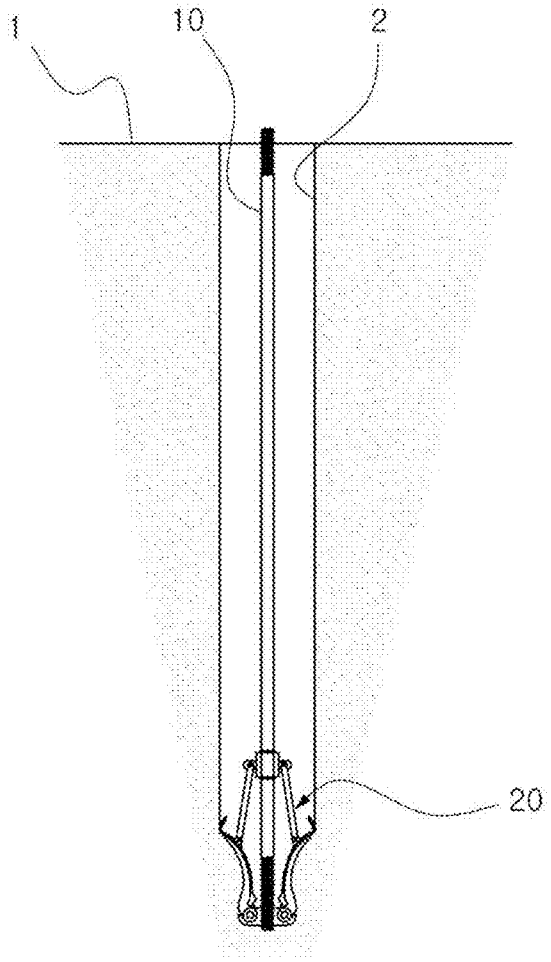

[FIG. 5]
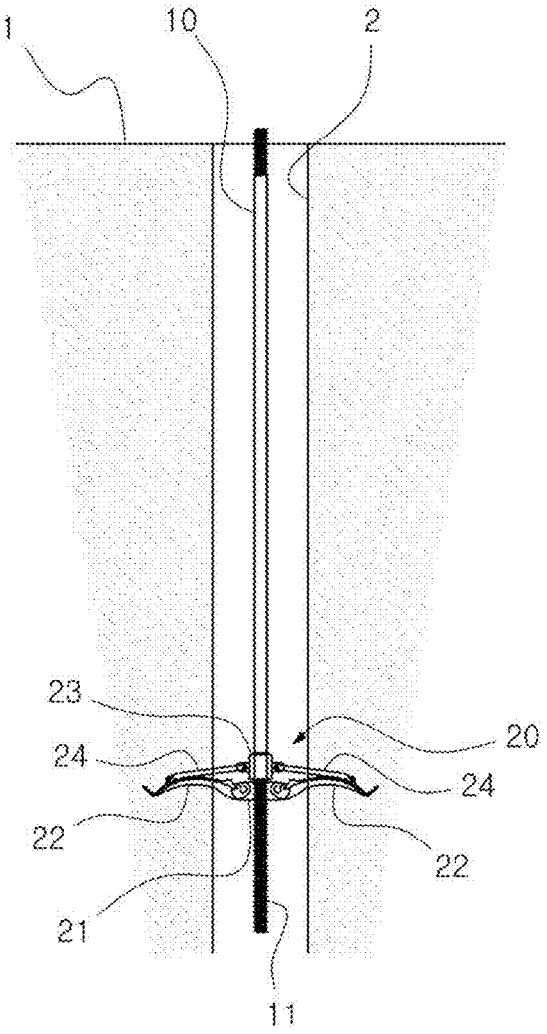

[FIG. 6]
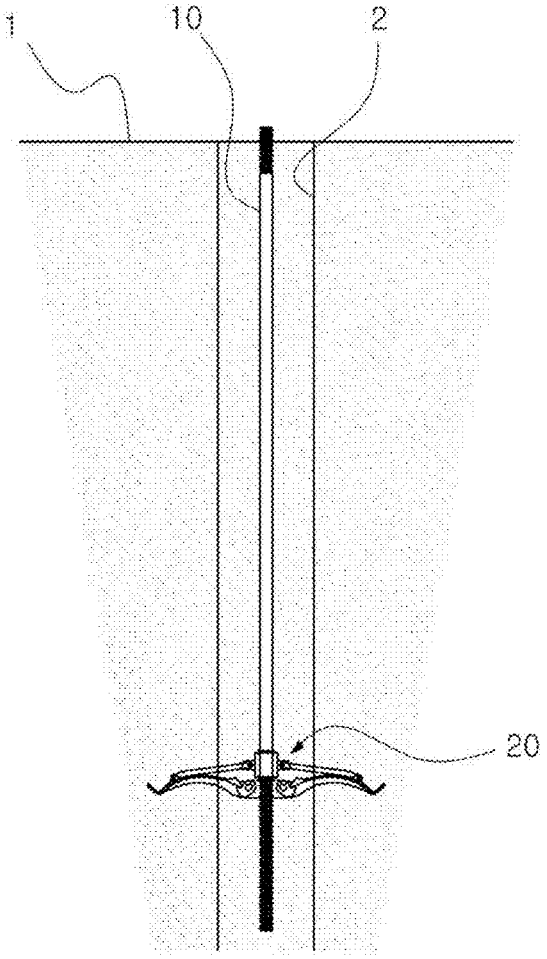

[FIG. 7]
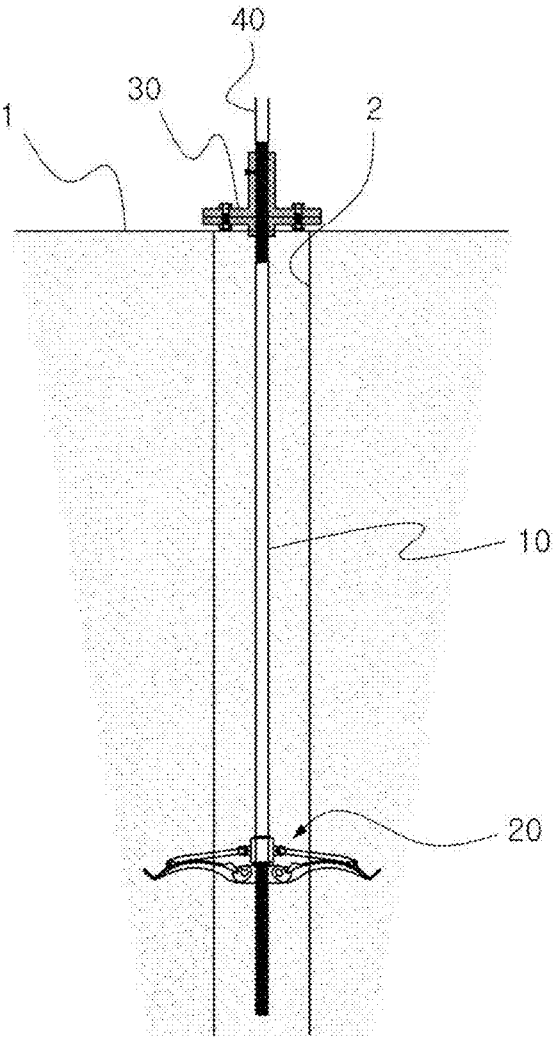

[FIG. 8]
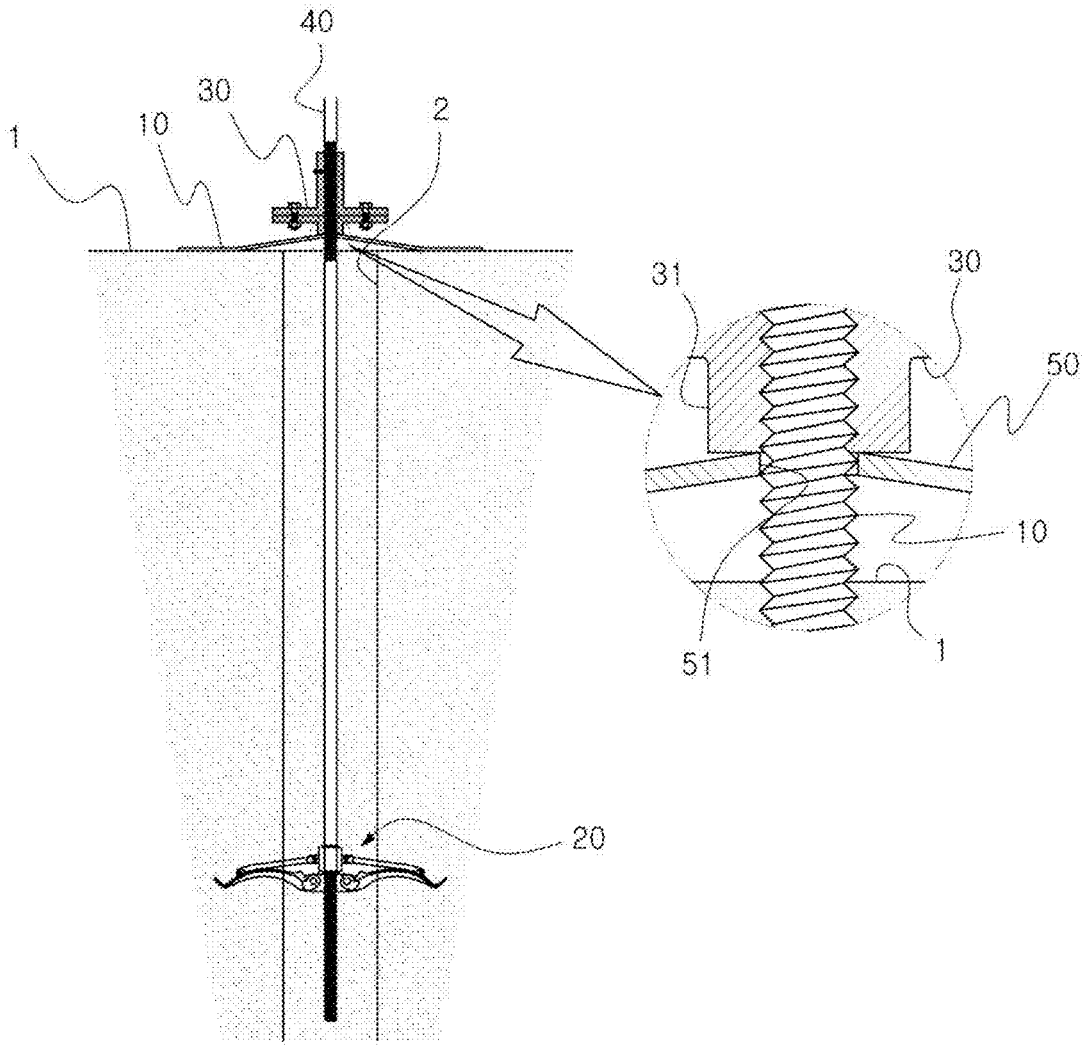

[FIG. 9]
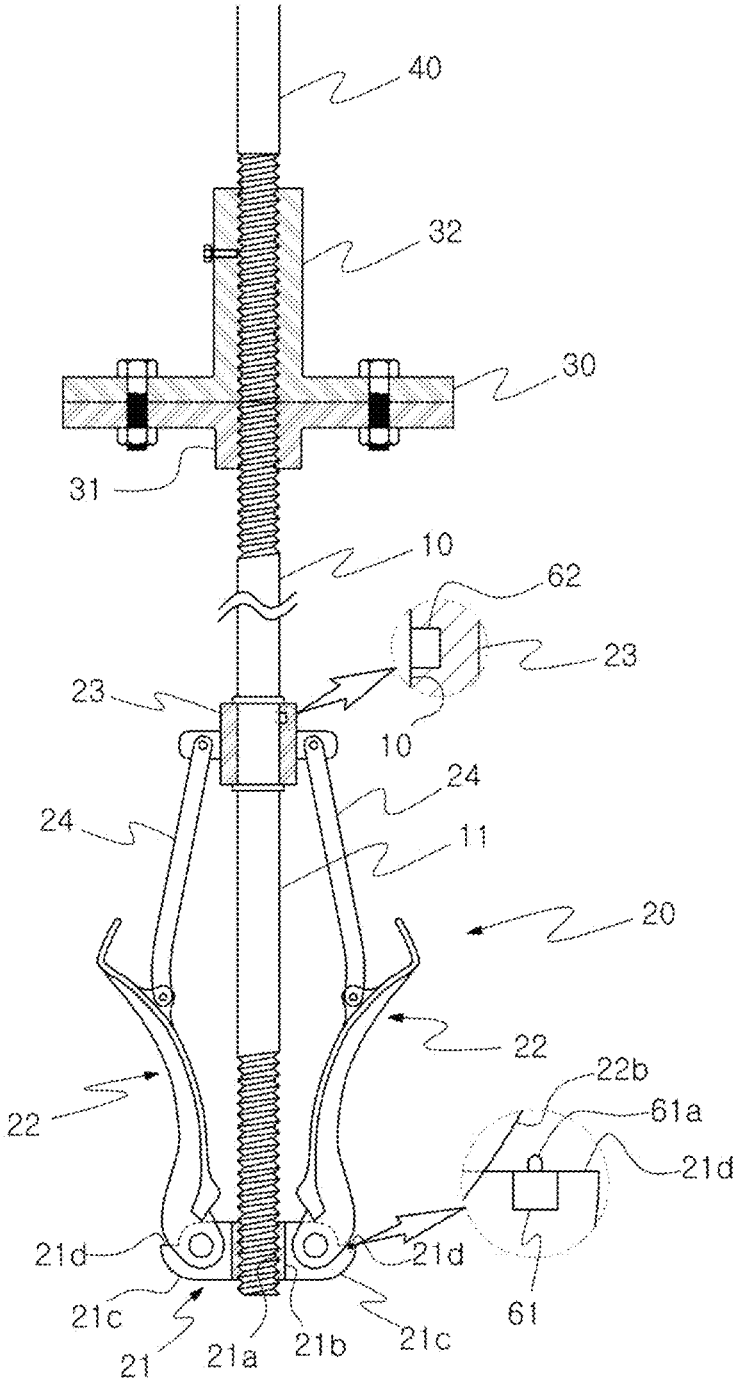

[FIG. 10]
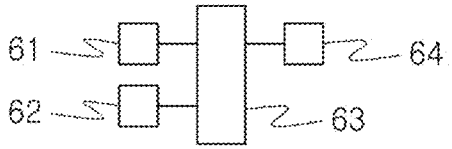

[FIG. 11]
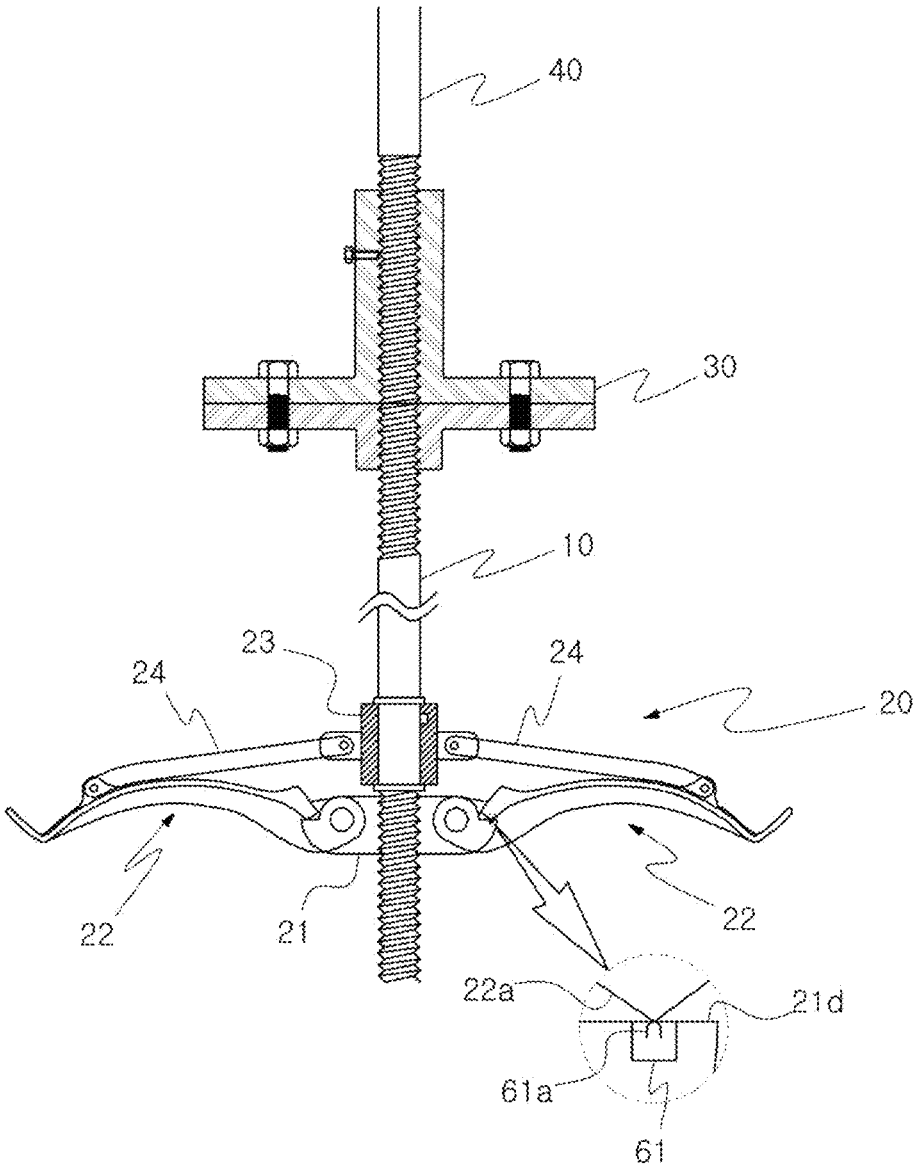

SAFETY RECOVERY SUPPORT FIXTURE

CROSS-REFERENCE TO RELATED APPLICATION

This application claims priority to and the benefit of Korean Patent Application No. 10-2023-0192681, filed on Dec. 27, 2023, the disclosure of which is incorporated herein by reference in its entirety.

BACKGROUND

1. Field of the Invention

The present invention relates to a safety recovery support fixture with a new structure that can easily be fixed to be buried in the ground, tidal flats, the ocean, or the like and can easily be recovered as necessary.

2. Discussion of Related Art

Generally, when constructing a structure on the ground, tidal flats, or the ocean, a support fixture such as a pile is installed to be buried in the ground, tidal flats, or ocean, and a structure is constructed on an upper portion of the support fixture so that the support fixture supports the structure.

However, such a support fixture has problems that not only is it inconvenient and expensive to construct, but there are also many restrictions on the construction site, and construction on sloped sites, etc. is not possible.

In addition, such a support fixture has a problem that environmental destruction occurs due to an inability to recover the support fixture when the structure is demolished after use.

Therefore, there is a need for a new method that can address the above problems.

RELATED ART DOCUMENT

Patent Document (Patent Document 1) Korean Patent Registration No. 10-1569865

SUMMARY OF THE INVENTION

The present invention is directed to providing a safety recovery support fixture with a new structure that can easily be fixed to be buried in the ground, tidal flats, the ocean, or the like and can easily be recovered as necessary.

According to an aspect of the present invention, there is provided a safety recovery support fixture including a support bar (10) extending in an up-down direction and having screw threads (11) formed on a circumferential surface of a lower end, and a fixer (20) disposed at the lower end of the support bar (10), wherein the fixer (20) includes a lifting/lowering block (21) extending in a lateral direction and having a coupling hole (21*a*), which is screw-coupled to the screw threads (11) of the support bar (10), formed at a central portion to pass through upper and lower surfaces, a pair of anchor blades (22) coupled to both ends of the lifting/lowering block (21) to be pivotable in the up-down direction, a support block (23) extending in the lateral direction and having a through-hole (23*a*), to which the support bar (10) is rotatably coupled, formed at a central portion, and a pair of connecting rods (24) coupled to both ends of the support block (23) to be pivotable in the up-down direction and having distal end portions hinge-coupled to the anchor blades (22), and when the support bar (10) is rotated in a state in which the fixer (20) is buried, as the lifting/lowering block moves upward due to a screw action of the screw threads (11), the anchor blades (22) are pivoted outward and fixed.

According to another feature of the present invention, a catching step (21*d*) having an upper surface on which the anchor blade (22) is seated may be formed at each of opposite ends of the lifting/lowering block (21), the anchor blade (22) may include an anchor plate (22*a*) extending in the up-down direction and a blade main body (22*b*) disposed at an outer side surface of the anchor plate (22*a*) and having a lower end pivotably coupled to the lifting/lowering block (21), and when the anchor blade (22) is pivoted downward, a lower end of the anchor plate (22*a*) may be seated on the upper surface of the catching step (21*d*) and fixed.

According to still another feature of the present invention, the fixer (20) may be installed to be inserted into an excavation hole (2) formed in a ground surface (1), the safety recovery support fixture may further include a support plate (50) having a through-hole (51), through which the support bar (10) passes, formed therein and coupled to an upper end of the support bar (10) to come in close contact with the ground surface (1), a connector (30) coupled to the upper end of the support bar (10), and a support fixture (40) coupled to the connector (30) and supporting a structure, and the support plate (50) may be configured in the form of a disk spring of which a central portion protrudes upward.

According to yet another feature of the present invention, the safety recovery support fixture may further include a close contact detector (61) disposed at the catching step (21*d*) to detect close contact between the anchor plate (22*a*) of the anchor blade (22) and the catching step (21*d*), a rotation detector (62) disposed at the support block (23) to detect rotation of the support bar (10), a controller (63) receiving signals from the close contact detector (61) and the rotation detector (62), and an alarm device (64) connected to the controller (63), wherein, when the signals received from the close contact detector (61) and the rotation detector (62) indicate that the anchor plate (22*a*) is spaced apart from the catching step (21*d*) in a state in which the support bar (10) is not rotated, the controller (63) operates the alarm device (64) to inform of the same.

BRIEF DESCRIPTION OF THE DRAWINGS

The above and other objects, features, and advantages of the present invention will become more apparent to those of ordinary skill in the art by describing exemplary embodiments thereof in detail with reference to the accompanying drawings, in which:

FIG. 1 is a front cross-sectional view illustrating a safety recovery support fixture according to the present invention;

FIG. 2 is a perspective view illustrating the safety recovery support fixture according to the present invention;

FIG. 3 is a front cross-sectional view illustrating an unfolded state of the safety recovery support fixture according to the present invention;

FIGS. 4 to 7 are reference views illustrating a method of constructing the safety recovery support fixture according to the present invention;

FIG. 8 is a front cross-sectional view illustrating a second embodiment of the safety recovery support fixture according to the present invention;

FIG. 9 is a front cross-sectional view illustrating a third embodiment of the safety recovery support fixture according to the present invention;

FIG. 10 is a block diagram of the third embodiment of the safety recovery support fixture according to the present invention; and FIG. 11 is a reference view illustrating actions of the safety recovery support fixture according to the present invention.

DETAILED DESCRIPTION OF EXEMPLARY EMBODIMENTS

Hereinafter, the present invention will be described in detail based on the accompanying drawings.

FIGS. 1 to 7 illustrate a safety recovery support fixture according to the present invention that is fixed to a typical ground surface 1.

According to FIGS. 1 to 7, the safety recovery support fixture according to the present invention includes a support bar 10 extending in an up-down direction and having screw threads 11 formed on a circumferential surface of a lower end, a fixer 20 disposed at the lower end of the support bar 10, a connector 30 coupled to an upper end of the support bar 10, and a support fixture 40 coupled to the connector 30 and supporting a structure.

The support bar 10 is configured in the form of a round bar that extends in the up-down direction and has the screw threads 11 formed on the lower end.

The fixer 20 includes a lifting/lowering block 21 extending in a lateral direction and having a coupling hole 21*a*, which is screw-coupled to the screw threads 11 of the support bar 10, formed at a central portion to pass through upper and lower surfaces, a pair of anchor blades 22 coupled to both ends of the lifting/lowering block 21 to be pivotable in the up-down direction, a support block 23 extending in the lateral direction and having a through-hole 23*a*, to which the support bar 10 is rotatably coupled, formed at a central portion, and a pair of connecting rods 24 coupled to both ends of the support block 23 to be pivotable in the up-down direction and having distal end portions hinge-coupled to the anchor blades 22.

The lifting/lowering block 21 includes a tubular member 21*b* extending in the up-down direction and having the coupling hole 21*a* formed therein and a pair of brackets 21*c* disposed at both sides of the tubular member 21*b*.

In addition, a catching step 21*d* having an upper surface on which the anchor blade 22 is seated is formed at each of opposite ends of the lifting/lowering block 21, that is, at outer ends of the brackets 21*c*.

The anchor blade 22 includes an anchor plate 22*a* extending in the up-down direction and a blade main body 22*b* disposed at an outer side surface of the anchor plate 22*a* and having a lower end pivotably coupled to the lifting/lowering block 21.

At this time, a width of the anchor plate 22*a* in a front-rear direction is formed to be thicker than a width of the blade main body 22*b* so that front and rear side surfaces of the anchor plate 22*a* protrude in a front-rear direction of the blade main body 22*b*.

In addition, an upper end of the anchor plate 22*a* is bent in a direction adjacent thereto.

Accordingly, as illustrated in FIG. 3, when the anchor blade 22 is pivoted downward, a lower end of the anchor plate 22*a* is seated on the upper surface of the catching step 21*d* and fixed so as not to be pivoted downward.

The support block 23 is coupled to the support bar 10 to be rotatable but not be able to move upward or downward so that the support block 23 is located above the screw threads 11.

To this end, a protruding step 12 supporting the upper and lower surfaces of the lifting/lowering block 21 is formed on the support bar 10.

In addition, brackets 23*b* to which upper ends of the connecting rods 24 are hinge-coupled are disposed at both sides of the support block 23.

The connector 30 is configured in a disc shape, a lower coupling tube 31 screw-coupled to the upper end of the support bar 10 is disposed at a lower side of the connector 30, and an upper coupling tube 32 to which the support fixture 40 is screw-coupled is disposed at an upper side of the connector 30.

A method of installing the safety recovery support fixture configured as above in the ground surface 1 will be described below.

First, as illustrated in FIG. 4, an appropriate excavation hole 2 is formed in the ground surface 1, and the fixer 20 is inserted into the excavation hole 2. In this state, when the support bar 10 is rotated, as illustrated in FIG. 5, the lifting/lowering block 21 moves upward due to a screw action of the screw threads 11, and accordingly, the connecting rods 24 are pivoted upward, and the anchor blades 22 are pivoted outward.

As a result, upper ends of the anchor blades 22 are fixed after digging into a circumferential portion of the excavation hole 2.

At this time, the lower end of the anchor plate 22*a* of each anchor blade 22 is seated on the upper surface of the catching step 21*d*, and each anchor blade 22 is fixed so as not to be pivoted further.

In addition, construction of a structure may be completed after filling the excavation hole 2 with soil to close the excavation hole 2 as illustrated in FIG. 6, and then coupling the connector 30 and the support fixture 40 to the upper end of the support bar 10 and fixing the structure to the support fixture 40 as illustrated in FIG. 7.

In addition, in a case in which the structure is demolished, when the support bar 10 is rotated in the opposite direction, the lifting/lowering block 21 moves downward, and the anchor blades 22 are pivoted upward.

As a result, areas of the anchor blades 22 decrease, and workers are able to pull the support bar 10 upward and pull out and remove the safety recovery support fixture upward from the ground surface 1.

The safety recovery support fixture configured as above includes the support bar 10 extending in the up-down direction and having the screw threads 11 formed on the circumferential surface of the lower end, and the fixer 20 disposed at the lower end of the support bar 10, the fixer 20 includes the lifting/lowering block 21 extending in the lateral direction and having the coupling hole 21*a*, which is screw-coupled to the screw threads 11 of the support bar 10, formed at the central portion to pass through the upper and lower surfaces, the pair of anchor blades 22 coupled to both ends of the lifting/lowering block 21 to be pivotable in the up-down direction, the support block 23 extending in the lateral direction and having the through-hole 23*a*, to which the support bar 10 is rotatably coupled, formed at the central portion, and the pair of connecting rods 24 coupled to both ends of the support block 23 to be pivotable in the up-down direction and having the distal end portions hinge-coupled to the anchor blades 22, and in this way, the safety recovery support fixture can be fixed to the ground surface 1 by spreading the anchor blades 22 in the state in which the fixer 20 is inserted into the ground surface 1 and can be removed by being pulled upward in the state in which the anchor blades 22 are narrowed.

Accordingly, the safety recovery support fixture can be firmly fixed to the ground surface 1 to support a structure and can be easily recovered after the structure is demolished, and there is an advantage that environmental destruction can be prevented.

In addition, the catching step 21*d* having the upper surface on which the anchor blade 22 is seated is formed at each of opposite ends of the lifting/lowering block 21, the anchor blade 22 includes the anchor plate 22*a* extending in the up-down direction and the blade main body 22*b* disposed at the outer side surface of the anchor plate 22*a* and having the lower end pivotably coupled to the lifting/lowering block 21, and when the anchor blade 22 is pivoted downward, the lower end of the anchor plate 22*a* is seated on the upper surface of the catching step 21*d* and fixed.

Accordingly, there is an advantage that it is possible to effectively prevent the anchor blades 22 from moving in the up-down direction in a state in which the anchor blades 22 are spread outward and fixed to the ground surface 1.

In the case of the present embodiment, the safety recovery support fixture has been described as being installed on the ground surface 1, but the safety recovery support fixture may be installed on the bottom of a tidal flat or the ocean.

FIG. 8 illustrates another embodiment according to the present invention in which a support plate 50 supporting a lower side surface of the connector 30 is disposed on the upper end of the support bar 10.

The support plate 50 has a through-hole 51, through which the support bar 10 passes, formed therein and is coupled to the upper end of the support bar 10 to come in close contact with the ground surface 1. The support plate 50 is configured in the form of a disk spring of which a central portion protrudes upward.

In the safety recovery support fixture configured as above, since the support plate 50 is disposed on the upper end of the support bar 10 and comes in close contact with a wide area of the ground surface 1, a load applied to the safety recovery support fixture is transferred to be widely distributed to the ground surface 1 through the support plate 50, and there is an advantage that it is possible to more effectively prevent the safety recovery support fixture from subsiding due to a load of the structure.

In particular, since the support plate 50 is configured in the form of a disk spring of which the central portion protrudes upward, there is an advantage that the support plate 50 can be elastically deformed and absorb impact when strong impact is applied due to an earthquake, etc.

FIGS. 9 to 11 illustrate a third embodiment according to the present invention in which the safety recovery support fixture further includes a close contact detector 61 disposed at the catching step 21*d* to detect close contact between the anchor plate 22*a* of the anchor blade 22 and the catching step 21*d*, a rotation detector 62 disposed at the support block 23 to detect rotation of the support bar 10, a controller 63 receiving signals from the close contact detector 61 and the rotation detector 62, and an alarm device 64 connected to the controller 63.

The close contact detector 61 is disposed to be buried in the catching step 21*d* and uses a limit switch having a push button 61*a* protruding upward from an upper surface thereof. As illustrated in FIG. 11, when the lower end of the anchor plate 22*a* comes in close contact with the catching step 21*d*, the push button 61*a* is pressed downward, and the close contact is detected.

The rotation detector 62 is disposed in the through-hole 23*a* of the support block 23 and uses a rotation sensor that detects rotation of the support bar 10 coupled to the through-hole 23*a*.

Since various types of rotation sensors have been developed and used for various purposes, detailed description of the rotation sensor will be omitted.

The alarm device 64 is configured to output an alarm sound when operated.

In the safety recovery support fixture configured as above, the controller 63 monitors signals from the close contact detector 61 and the rotation detector 62 that indicate whether the anchor blades 22 are pivoted outward and the lower ends of the anchor plates 22*a* are in close contact with the catching steps 21*d*.

In addition, when the rotation detector 62 detects that the anchor plates 22*a* of the anchor blades 22 are spaced apart from the catching steps 21*d* in a state in which the support bar 10 is not rotated, the controller 63 determines that an abnormality has occurred in the fixer 20 and operates the alarm device 64 to inform of the abnormality.

That is, in a normal state of the fixer 20, the anchor blades 22 should not be pivoted upward unless the support bar 10 is rotated.

However, the anchor plates 22*a* of the anchor blades 22 being spaced apart from the catching steps 21*d* even when rotation of the support bar 10 is not detected by the rotation detector 62 indicates that an abnormality has occurred in the fixer 20.

Accordingly, there is an advantage in that, when an abnormality that cannot be found visually occurs in the fixer 20, the alarm device 64 is operated to inform workers of the abnormality so that the workers can promptly maintain and repair the safety recovery support fixture.

A safety recovery support fixture according to the present invention includes a support bar 10 extending in an up-down direction and having screw threads 11 formed on a circumferential surface of a lower end, and a fixer 20 disposed at the lower end of the support bar 10, the fixer 20 includes a lifting/lowering block 21 extending in a lateral direction and having a coupling hole 21*a*, which is screw-coupled to the screw threads 11 of the support bar 10, formed at a central portion to pass through upper and lower surfaces, a pair of anchor blades 22 coupled to both ends of the lifting/lowering block 21 to be pivotable in the up-down direction, a support block 23 extending in the lateral direction and having a through-hole 23*a*, to which the support bar 10 is rotatably coupled, formed at a central portion, and a pair of connecting rods 24 coupled to both ends of the support block 23 to be pivotable in the up-down direction and having distal end portions hinge-coupled to the anchor blades 22, and in this way, the safety recovery support fixture can be fixed to a ground surface 1 by spreading the anchor blades 22 in a state in which the fixer 20 is inserted into the ground surface 1 and can be removed by being pulled upward in a state in which the anchor blades 22 are narrowed.

Accordingly, the safety recovery support fixture can be firmly fixed to the ground surface 1 to support a structure and can be easily recovered after the structure is demolished, and there is an advantage that environmental destruction can be prevented.

What is claimed is:

1. A safety recovery support fixture comprising:

a support bar (10) extending in an up-down direction and having screw threads (11) formed on a circumferential surface of a lower end; and a fixer (20) disposed at the lower end of the support bar (10), wherein the fixer (20) includes a lifting/lowering block (21) extending in a lateral direction and having a coupling hole (21*a*), which is screw-coupled to the screw threads (11) of the support bar (10), formed at a central portion to pass through upper and lower surfaces, a pair of anchor blades (22) coupled to both ends of the lifting/lowering block (21) to be pivotable in the up-down direction, a support block (23) extending in the lateral direction and having a through-hole (23*a*), to which the support bar (10) is rotatably coupled, formed at a central portion, and a pair of connecting rods (24) coupled to both ends of the support block (23) to be pivotable in the up-down direction and having distal end portions hinge-coupled to the anchor blades (22), when the support bar (10) is rotated in a state in which the fixer (20) is buried, as the lifting/lowering block moves upward due to a screw action of the screw threads (11), the anchor blades (22) are pivoted outward and fixed, a catching step (21*d*) having an upper surface on which the anchor blade (22) is seated is formed at each of opposite ends of the lifting/lowering block (21), the anchor blade (22) includes an anchor plate (22*a*) extending in the up-down direction and a blade main body (22*b*) disposed at an outer side surface of the anchor plate (22*a*) and having a lower end pivotably coupled to the lifting/lowering block (21), when the anchor blade (22) is pivoted downward, a lower end of the anchor plate (22*a*) is seated on the upper surface of the catching step (21*d*) and fixed, the fixer (20) is installed to be inserted into an excavation hole (2) formed in a ground surface (1), the safety recovery support fixture further comprises a support plate (50) having a through-hole (51), through which the support bar (10) passes, formed therein and coupled to an upper end of the support bar (10) to come in close contact with the ground surface (1), a connector (30) coupled to the upper end of the support bar (10), and a support fixture (40) coupled to the connector (30) and supporting a structure, the support plate (50) is configured in the form of a disk spring supporting a lower side surface of the connector 30 and having a central portion that protrudes upward, and the connector (30) is configured in a disc shape, a lower coupling tube (31) screw-coupled to the upper end of the support bar (10) is disposed at a lower side of the connector (30), and an upper coupling tube (32) to which the support fixture (40) is screw-coupled is disposed at an upper side of the connector (30).

2. The safety recovery support fixture of claim 1, further comprising:

a close contact detector (61) disposed at the catching step (21*d*) to detect close contact between the anchor plate (22*a*) of the anchor blade (22) and the catching step (21*d*);

a rotation detector (62) disposed at the support block (23) to detect rotation of the support bar (10);

a controller (63) receiving signals from the close contact detector (61) and the rotation detector (62); and an alarm device (64) connected to the controller (63), wherein, when the signals received from the close contact detector (61) and the rotation detector (62) indicate that the anchor plate (22*a*) is spaced apart from the catching step (21*d*) in a state in which the support bar (10) is not rotated, the controller (63) operates the alarm device (64) to inform of the same.

* * * * *